US006679140B1

(12) United States Patent
Flavigny

(10) Patent No.: US 6,679,140 B1
(45) Date of Patent: Jan. 20, 2004

(54) SELF-ADJUSTING PLIERS FOR SINGLE-HANDED MANIPULATION

(75) Inventor: Jean-Pierre Flavigny, Saint pe sur Nivelle (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 10/088,414

(22) PCT Filed: Sep. 15, 2000

(86) PCT No.: PCT/FR00/02576

§ 371 (c)(1),
(2), (4) Date: Mar. 20, 2002

(87) PCT Pub. No.: WO01/23144

PCT Pub. Date: Apr. 5, 2001

(30) Foreign Application Priority Data

Sep. 27, 1999 (FR) ..... 99 12009

(51) Int. Cl.[7] ..... B25B 7/04
(52) U.S. Cl. ..... 81/357; 81/413
(58) Field of Search ..... 81/357–360, 407, 81/408, 409, 409.5, 413, 415–417, 427, 427.5

(56) References Cited

U.S. PATENT DOCUMENTS

| | | | | | |
|---|---|---|---|---|---|
| 1,386,149 | A | | 8/1921 | Allan | 81/407 |
| 1,508,510 | A | * | 9/1924 | Edwards | 81/356 |
| 1,639,183 | A | * | 8/1927 | Ingram | 81/411 |
| 1,651,216 | A | | 11/1927 | McGill | 81/342 |
| 2,906,155 | A | * | 9/1959 | Miller | 81/343 |
| 3,232,152 | A | | 2/1966 | Miller | 81/343 |
| 4,048,878 | A | * | 9/1977 | Nystrom | 81/409 |
| 6,014,917 | A | * | 1/2000 | Bally et al. | 81/355 |
| 6,378,404 | B1 | * | 4/2002 | Bally et al. | 81/355 |

FOREIGN PATENT DOCUMENTS

| | | | | |
|---|---|---|---|---|
| DE | 3502595 A | * | 7/1986 | B25B/7/00 |
| DE | 298 06 998 | | 7/1998 | |
| EP | 0 218 760 | | 4/1987 | |

* cited by examiner

*Primary Examiner*—Joseph J. Hail, III
*Assistant Examiner*—David B. Thomas
(74) *Attorney, Agent, or Firm*—Wenderoth, Lind & Ponack, L.L.P.

(57) ABSTRACT

A pair of pliers which is automatically and continuously self-adjusting. In the approach phase, a mobile branch (2) is guided by a cradle with two intermediate (4) and rear (32) supports.

32 Claims, 5 Drawing Sheets

SELF-ADJUSTING PLIERS FOR SINGLE-HANDED MANIPULATION

BACKGROUND OF THE INVENTION

1. Field of the Invention

The present invention relates to an adjustable pair of pliers that is operable with only one hand.

2. Description of the Related Art

EP-A-0 218 760 describes pliers of this type, in which the mutual guidance of the branches during the closure phase of the pliers is obtained by means of an articulated arm which passes through the space situated between the two handles. The closure phase is to be understood as meaning the step, in the use of the pliers, wherein, with the two jaws not in contact with an object that is to be grasped, forces are exerted on the handles in suitable directions that tend to bring the jaws closer together.

The main disadvantages of an articulated arm such as this are that there is a risk that the user will trap his fingers, that it is exposed to shock and dirt, and that any freedom of angular movement of the branches with respect to one another is eliminated.

SUMMARY OF THE INVENTION

The object of the invention is to provide an adjustable pair of pliers that is operable one-handedly, of relatively simple design, and which affords improved comfort, flexibility and safety in use, while at the same time allowing excellent control over the closure phase.

To this end, the subject of the invention is an adjustable pair of pliers of the aforementioned type.

The adjustable pliers according to the invention may have one or more of the characteristics described in the dependent claims taken in isolation or in any technically feasible combination.

BRIEF DESCRIPTION OF THE DRAWINGS

Exemplary embodiments of the invention will now be described with reference to the appended drawings, in which.

DETAILED DESCRIPTION OF THE INVENTION

Figures 1, 2:
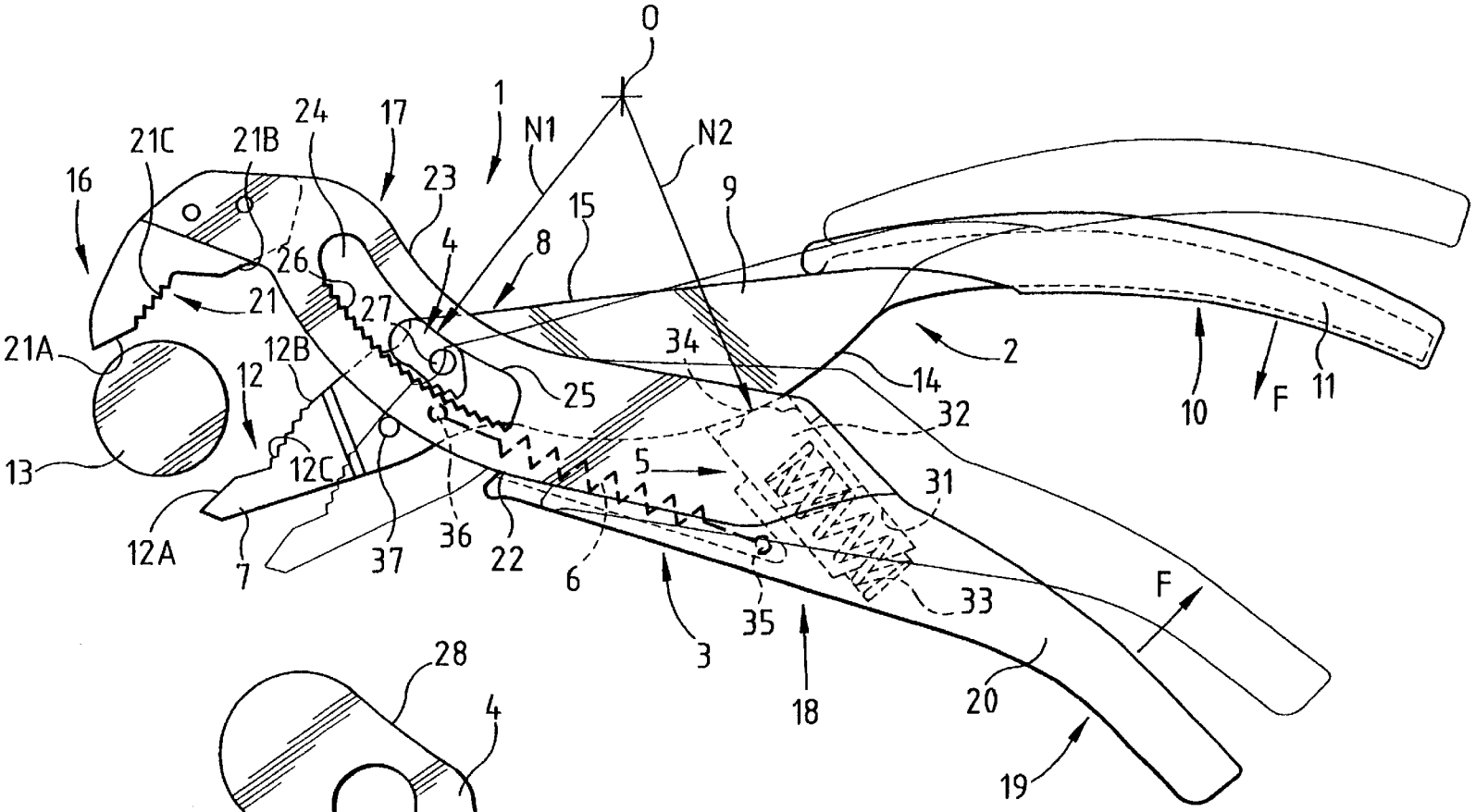
FIG. 1 is a schematic view of an adjustable pair of pliers according to the invention, in the position of rest and during the closure phase.
FIG. 2 depicts, on a larger scale, a detail of FIG. 1.

The adjustable pliers 1 depicted in FIG. 1 consist of two branches 2 and 3, of an articulation member or finger 4, of a bearing element 5 and of an opening spring 6.

The branch 2, or moving branch, consists of a solid metal component which defines, from front to rear, that is to say from left to right when considering FIG. 1, a moving jaw 7, an intermediate articulation region 8, a rear bearing region 9 and a handle 10. A sheath grip 11 may be attached to the latter, as depicted.

The jaws 7 have a toothed upper face 12 for gripping an object 13. The face 12 comprises roughly flat and coplanar end regions 12A,12B, separated by a region 12*c* in the form of a very open V.

The bearing region 9 comprises a convex lower surface 14 in the shape of a circular arc, the center O of which is a virtual point situated distinctly outside the contours of the tool, above the latter. The upper surface 15 of the branch 2, in the same region, is straight, and approximates to the cord subtended by the circular arc 14.

The handle 10 is curved, with its convex face facing upward.

The branch 3, or fixed branch, defines, from front to rear, a fixed jaw 16, attached to the main part of the branch by rivets, an intermediate articulation region 17, a rear bearing region 18 and a handle 19 clad with a sheath 20.

The jaw 16 comprises, on its lower face, a set of teeth 21 with two zones 21A,21B, which are more or less planar and coplanar, flanking a zone 21C in the form of a very open V. As depicted in the drawing, in the V zones of the jaws, only the rear part of the zone 12*c* and the front part of the zone 21C are toothed.

The region 17 has an arched overall shape of center O. It is delimited by plain upper and lower surfaces 22 and 23 in the form of circular arcs of center O, and comprises an arched slot 24. This is delimited by a plain upper surface 25 and by a sawtooth lower surface 26 forming a rack. Each of the surfaces 22 to 25 and the average line of the surface 26 are circular arcs of center O. The jaws 7 and 16 are entirely outside the circle of largest radius 22.

The articulation member 4 (FIG. 2) is a component of elongate shape articulated freely more or less mid-way along its length by a pivot 27 on the region 8 of the branch 2. This component comprises:

- a concave upper surface 28 which is circular and has the same radius as the surface 25;
- a lower surface which exhibits, at the rear, a set of sawtooth locking teeth 29 designed to engage with the set of teeth 26 and, at the front, a boss 30.

In its bearing region 18, the fixed branch 3 also comprises a blind housing 31 opened to the top and in which a slider 32 is accommodated. The latter is pushed upward by a spring 33 which in this instance is a helical compression spring, as far as a rest position as depicted, in which position the slider bears against a stop (not depicted) secured to the branch 3. The slider 32 at its upper part comprises a bearing protrusion 34 for the bearing surface 14 of the branch 2.

The opening spring 6, which is far weaker than the spring 33, is a tension coiled spring stretched between a point 35 on the branch 3 near the housing 31 and a point 36 on the branch 2 near the pivot 27 of the member 4 and situated between the circular arcs 22 and 26.

In FIG. 1, the moving branch is depicted in fine line in its rest position and in bolder line during the closure.

At rest, under the effect of the spring 6, the jaw 7 is pulled into its position of maximum separation from the jaw 16. To reach this position, the surface 14 slides along the protrusion 34 of the slider 36, until the member 4 comes into abutment against the rear end (the right-hand end in FIG. 1) of the slot 24. Of course, as an alternative, other stop means could be provided for limiting the opening of the two jaws.

To grip an object 13, a closure phase is first of all carried out by exerting a closing force F on the two handles as illustrated by the arrows.

Because of the relative stiffnesses of the two springs 6 and 33, this force first of all causes the branch 2 to rock slightly about the protrusion 34, until the upper surface 28 of the finger 4 presses against the upper surface 25 of the slot 24.

Continuing this same force causes the surface 14 to slide to the left over the protrusion 34 and, at the same time, causes the surface 28 of the finger 4 to slide along the surface 25, there being a small clearance between the finger and the set of teeth 26. The two bearing points—intermediate 28 and rear 34—form a cradle guiding the closing movement of the branch 2.

Thus, throughout closing, the point 34 is fixed with respect to the branch 3. In some instances, a sharp force exerted on the handles may cause slight compression of the spring 33, but the latter immediately returns to its original length. The point 34 is therefore always fixed or practically fixed with respect to the branch 3.

Throughout closing, the normals N1 and N2 to the points of contact 28,34 of the guide surface 25 and bearing surface 14 form a V, the point of which faces upward, that is to say away from the jaws. This V may have an angle slightly smaller than 90°, as depicted, or, as an alternative, an angle roughly equal to 90°.

Figure 3:
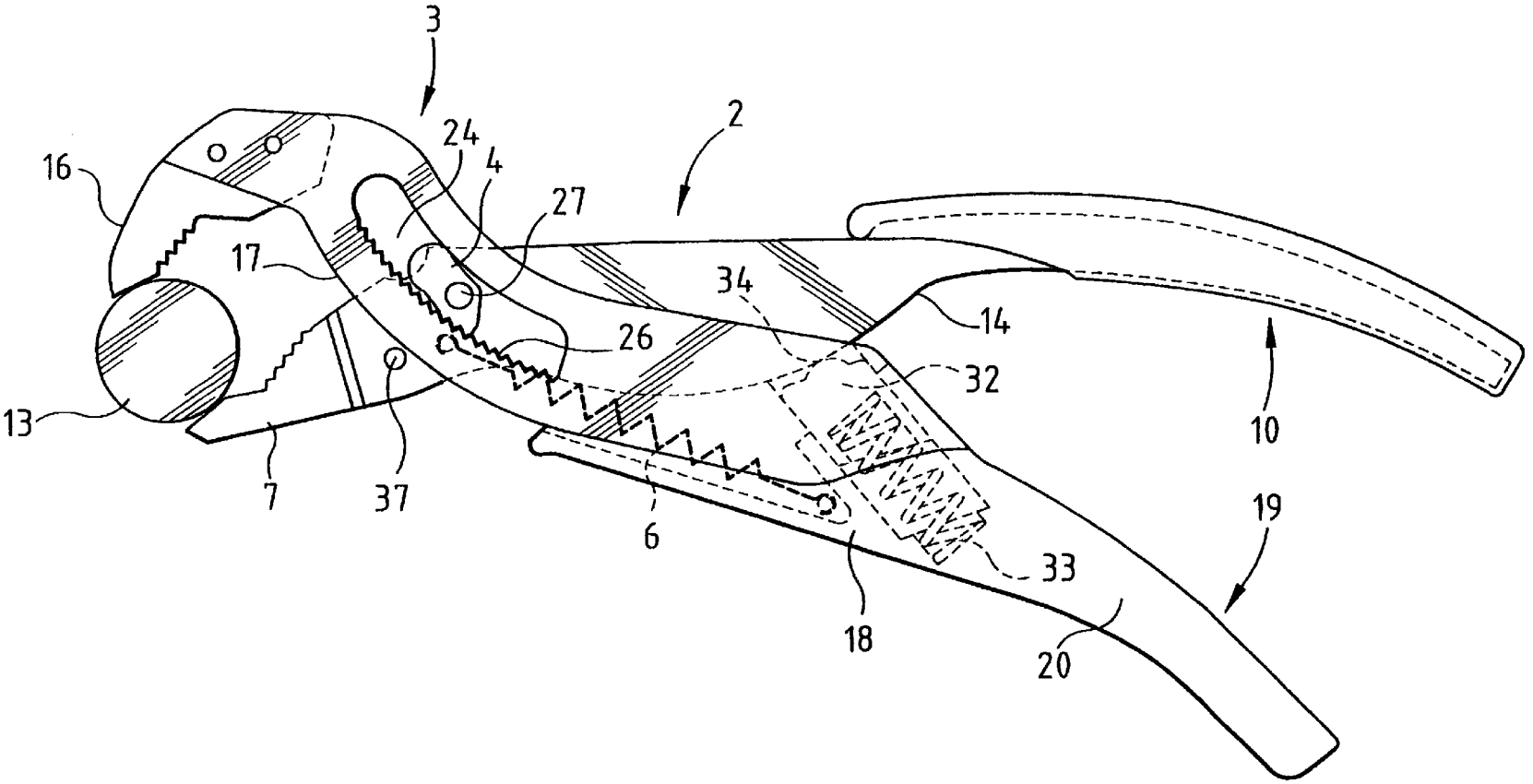
FIG. 3 is a similar view of the pliers of FIG. 1, while an object is being clamped.

This closing movement, which is performed against the action of the spring 6, continues until the two jaws come into contact with the object 13, then contact of the boss 30 with the set of teeth 26 causes the finger 4 to rock about its pivot 27 and brings the teeth 29 into contact with the set of teeth 26 (FIG. 3).

The point of contact of the moving jaws 7 with this object therefore defines a center of rotation, and continual application of the closing force on the two handles causes the branch 2 to rock about this center.

This movement, which is allowed by compression of the rear spring 33, causes the teeth 29 to engage and become locked in the set of teeth 26, this forming a new center of rotation for the branch 2. Continuing to apply the force to the two handles tends to cause the branch 2 to rock about this new center, which gives the effect of clamping the object 13. In this phase, the finger is braced between the set of teeth 26 and the surface 25. When the force exerted on the two handles is released, the teeth 29 disengage from the bottom of the set of teeth 26 under the effect of the spring 33. As the opposite end of the finger has remained in contact with the surface 25, this upward movement causes the finger to rock about its pivot 27. The finger thus quickly returns to its initial position of guidance on the surface 25, and the spring 6 then returns the entire branch backward until the jaws are wide open.

The pliers thus described have a relatively simple design and are very smooth and precise during the closure phase. In addition, the concave overall shape of the intermediate region of the tool, which is obtained by virtue of the surfaces 23 and 15, allows the front part of the pliers to be slipped into places which are difficult to access, for example behind a pipe. Likewise, the arched shape of the lower surface 22 gives the tool a particularly slender overall profile.

It should also be noted that by virtue of its arched shape, the slot 24 can easily comprise a rear part, the orientation of which approaches that of the moving handle 10. This reduces the force that has to be exerted on the handles in order to start closing, by comparison with the customary scenarios in which the slot is straight as in the aforementioned EP-A-0 218 760.

Furthermore, nothing extends between the rear parts of the two branches, and this protects the user's fingers.

A projecting stud 37 is provided on the branch 2, to the rear of the jaw 7. Once the handles have been opened to a certain extent, this stud butts up against the surface 22, thus limiting the opening of the handles.

Figure 4:
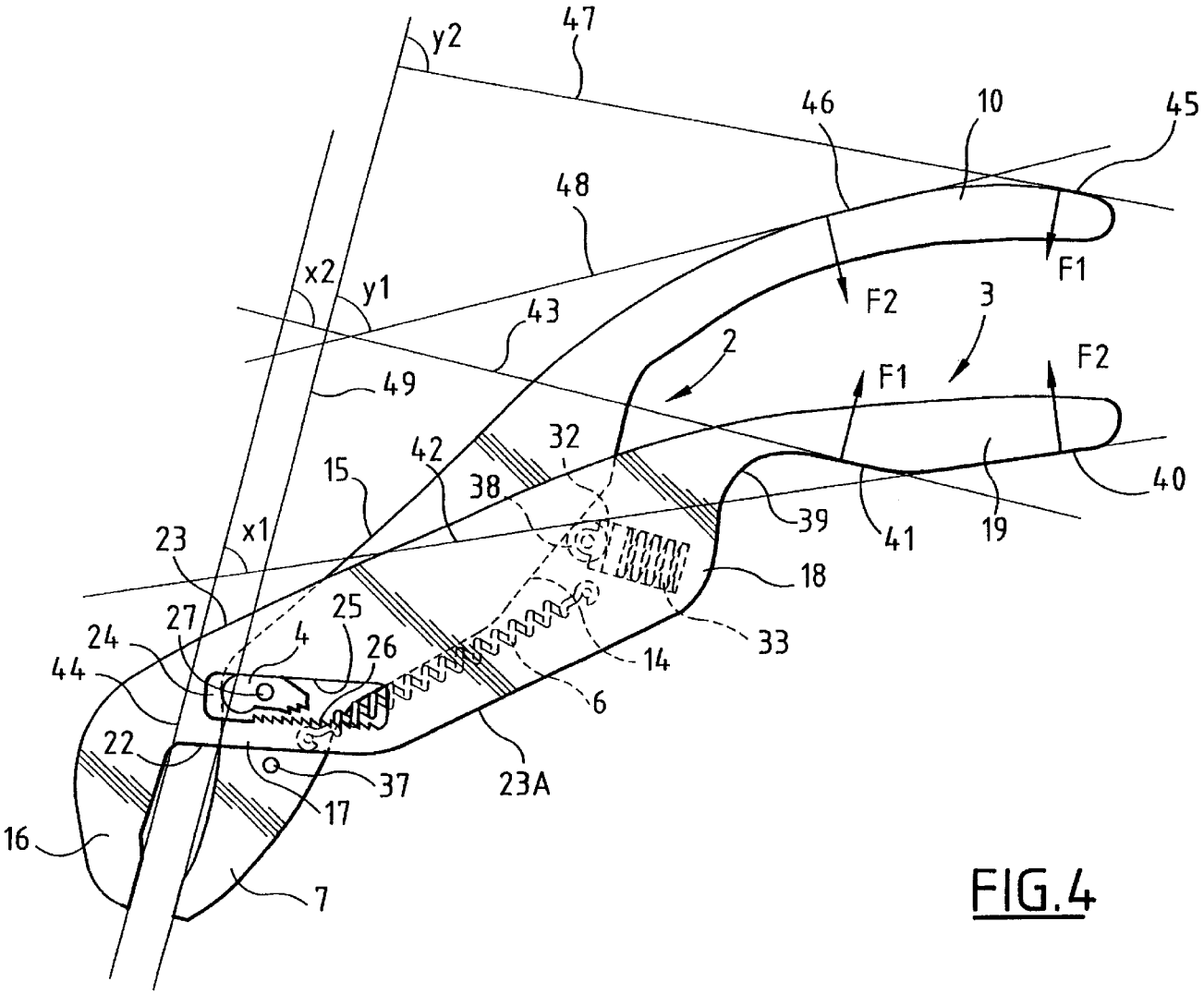
FIGS. 4 and 5 are similar views of two alternative forms of the pliers of FIGS. 1 to 3.

The alternative form in FIG. 4 differs from thee previous one in the following respects:

- the slot 24 is straight, as is the lower surface 22. The surfaces 22, 25 and the average line of the surface 26 are mutually parallel;
- the upper surface 23 is approximately straight, with an orientation diverging toward the rear with respect to that of the slot 24; the branch 3 has, facing this surface 23, a lower surface 23A roughly parallel to the former surface;
- the bearing surface 14 is straight and roughly parallel to the upper surface 15;
- this surface 14 bears, in rolling and/or in sliding, against a roller 38 borne by the upper end of the slider 32; and
- the distal zone of the handle 19, adjacent to the bearing region 18, has a recess 39.

Because of the recess 39, the lower surface of the handle 19 closest to the jaws defines two bearing zones, proximal 40 and distal 41, the respective average lines 42 and 43 of which form a certain angle between them. Thus, with respect to the average interior line 44 of the fixed jaw 16, the line 42 makes an angle x1 of between 45 and 55° and preferably of 50°, while the line 43 makes an angle x2 markedly larger than x1, of the order of 75 to 90°.

The handle 10 furthest away from the jaws has a convex upper surface, and this defines a proximal zone 45 and a distal zone 46, the respective average lines 47 and 48 of which form a certain angle between them. With respect to the average interior line 49 of the moving jaw 7, the line 48 makes an angle y1 of 45 to 55° and preferably of 50°, while the line 47 makes a larger angle y2, of the order of 75 to 90°.

The pair of surfaces 41 and 45 make the pliers' closure phase described above easier by virtue of the orientation of the closing force F1 exerted on them. The pair of surfaces 40 and 46 make the force of clamping the gripped object easier by virtue of the orientation of the force F2 exerted on them.

Figure 5:
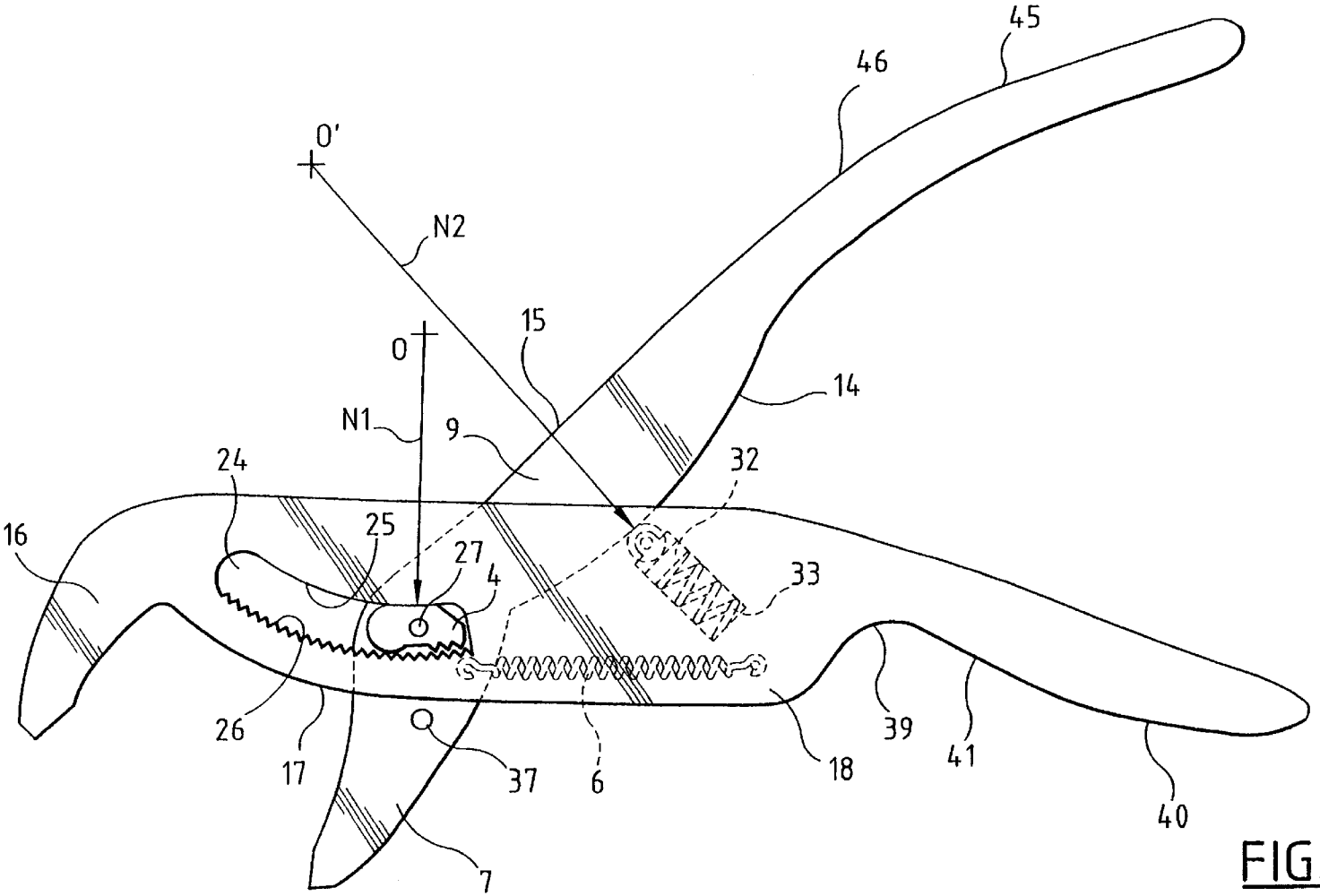

The alternative form in FIG. 5 is similar to that in FIG. 4, except in the following two respects:

- on the one hand, the slot 24 is arched, that is to say that its surface 25 and the average line of its surface 26 are circular arcs of center O;
- on the other hand, the bearing surface 14 is also a circular arc, but its center O' is distinct from the point O.

The embodiment in FIG. 6 operates in a similar way to the way described above, but with a structure modified as follows with respect to the embodiment in FIGS. 1 to 3.

The slot 24 is omitted. The rack 26 is formed on the upper surface 23 of the intermediate region 17 of the fixed branch, and the jaw 7 exhibits, at the rear and at the bottom, a rearward facing nose 50. The rack 26 is extended rearward by a plain bearing surface 114.

The rack 32 is borne by the moving branch 2, facing the surface 114, and is urged downward by the spring 33 as far as a limit position predetermined by a stop, not depicted.

The points 35 and 36 of attachment of the opening spring 6 are located respectively at the rear end of the handle 19 and slightly to the rear of the slider 32.

The finger 104 is articulated, by means of the pivot 27, to the branch 2 so that the teeth 29 are a distance away from the nose 50 which is greater than the thickness of the part 17, this being under the action of a spring 51 which keeps the front surface 30 of the finger in contact with the rear face of the intermediate part 17 of the fixed branch 3.

At rest, the spring 6 keeps the two jaws in the wide open position, this position being determined by appropriate stops (not depicted) for the two branches.

When the two handles start to be brought together, the branch 2 pivots slightly in the clockwise direction about the point of contact between the slider 32 and the surface 114, and this moves the pin 27 away from the rack 26 and brings the nose 50 into contact with the surface 22.

Figure 6:
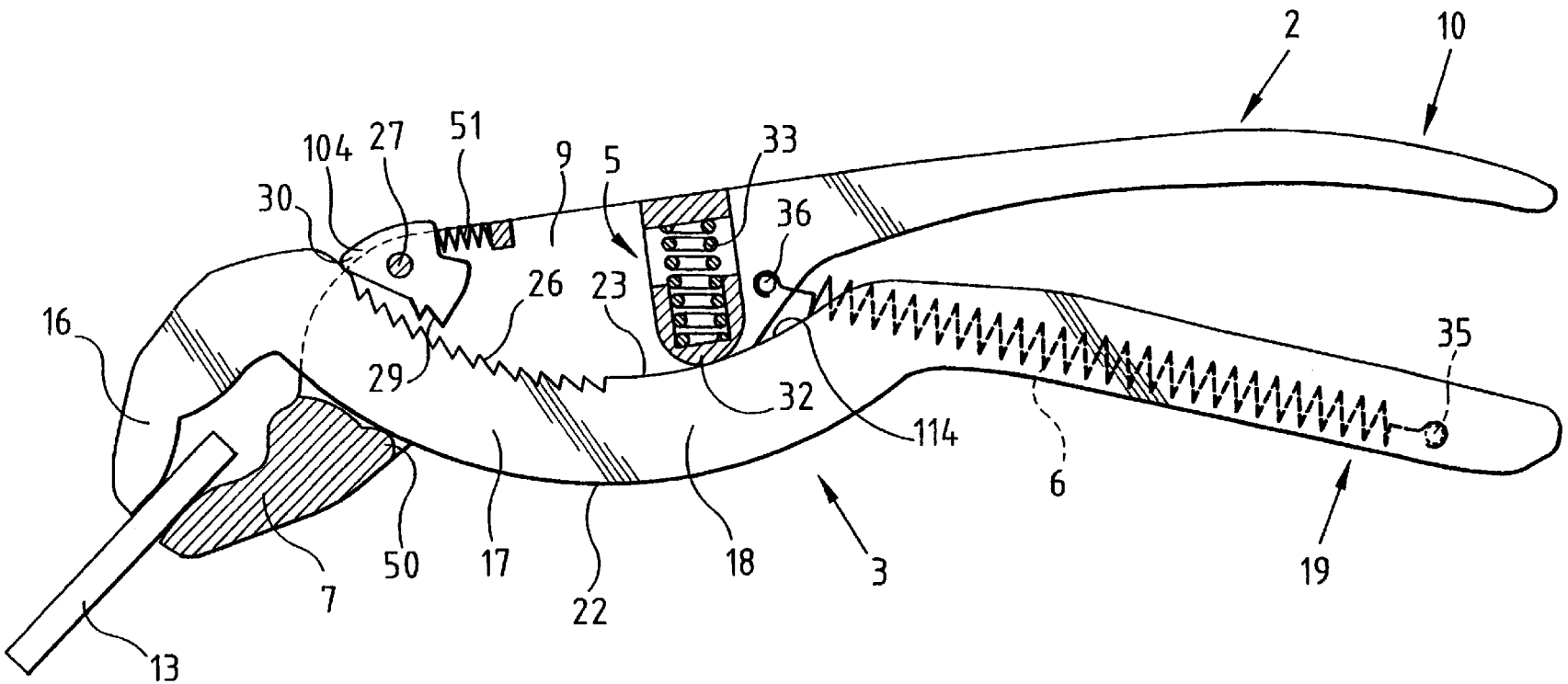
FIG. 6 is a similar view of a second embodiment of the pliers according to the invention.

Continued closing force applied to the two handles causes the slider 32 to move forward along the surface 114 and, at the same time, the nose 50 to move along the surface 22, until the two jaws come into contact with the object 13 (FIG. 6). Here again we have the V with the point uppermost and with an acute angle formed by the normal N1 and N2, as described above.

If the two handles continue to be closed, the branch 2 pivots first of all about its point of contact with the object 13, compressing the spring 33, until the teeth 29 of the finger 104 lock in the rack 26. This engagement then defines a new center of rotation for the branch 2, which allows the object 13 to be clamped as before. By virtue of the action of the spring 51, the teeth 29 disengage from the rack 26 when the handles of the pliers are released.

What is claimed is:

1. An adjustable pair of pliers operable one-handedly, said pliers comprising:

first and second branches which cross, each of said branches defining a jaw and a handle, and an intermediate articulation region between the jaw and the handle; and an opening spring which tends to move the two jaws constantly apart, the first branch having, in its intermediate region, a guide surface of elongate shape along which a guide means secured to the intermediate region of the second branch can move, and, an articulation surface along which an articulation means can be positioned, the pliers further comprising means for locking the articulation means along the articulation surface, wherein the pliers comprise a rear bearing region which is defined, on the one hand, by a bearing element of one of the first and second branches and, on the other hand, by a bearing surface of elongate shape of the other of the first and second branches and which is arranged to cooperate with the bearing element by a mutual bearing movable along the bearing surface, the bearing element and the bearing surface being situated between the intermediate region and the handle of the respective branches, the arrangement being such that during the closure phase of the pliers, in each position of the first and second branches, the bearing surface and the bearing element both remain in a roughly fixed position with respect to the respective branches, and a relative movement of the guide means along the guide surface and a relative movement of the bearing element along the bearing surface occur simultaneously.

2. The pliers as claimed in claim 1, wherein a gripping zone of each of the handles exhibits a proximal region and a distal region, an average line of the proximal region of the handle furthest from the jaws forming, with an average interior line of the associated jaw, an angle which is larger than an angle formed with an average interior line by an average line of the distal region of the same gripping zone, whereas an average line of the proximal region of the other handle forms, with an average interior line of the associated jaw, an angle which is smaller than the angle formed with the average interior line by an average line of the distal region of the same gripping zone.

3. The pliers as claimed in claim 1, wherein a gripping zone of each handle exhibits a proximal region and a distal region, the proximal region of the handle furthest away from the jaws and the distal region of the other handle constituting a pair of surfaces that is held in the hand during the closure phase, the distal region of the handle furthest away from the jaws and the proximal region of the other handle forming a pair of surfaces that is held in the hand during the clamping phase.

4. The pliers as claimed in claim 3, wherein each of the regions constituting the pair of surfaces held in the hands during the clamping phase forms, at least at a point, with an average interior line of the jaw of the branch which bears the region, an angle of between 45° and 55°.

5. The pliers as claimed in claim 4, wherein said angle is 50°.

6. The pliers as claimed in claim 3, wherein each of the regions constituting the pair of surfaces held in the hand during the closure phase forms, at least at a point, with an average interior line of the jaw of the branch which bears the region, an angle of between 75° and 90°.

7. The pliers as claimed in claim 1, wherein the handle closest to the jaw defines, on its outside, a recess in the location where it meets the rear bearing region.

8. The pliers as claimed in claim 1, wherein the guide surface is arched, with a virtual center of curvature situated outside the overall perimeter of the first and second branches and on the opposite side of the guide surface relative to the jaws.

9. The pliers as claimed in claim 8, wherein the guide surface is circular.

10. The pliers as claimed in claim 1, wherein, in its intermediate region, the first branch has, starting from its jaw and along its edge facing towards the latter, an arched, particularly circular, profile, with the concave side facing toward the opposite side of the first and second branches relative to the jaws.

11. The pliers as claimed in claim 1, wherein the bearing surface is arched, with a virtual center of curvature situated outside the overall perimeter of the first and second branches and on the opposite side of the bearing surface relative to the jaws.

12. The pliers as claimed in claim 11, wherein the bearing surface is circular.

13. The pliers as claimed in claim 8, wherein the bearing surface is arched, with a virtual center of curvature situated outside the overall perimeter of the first and second branches and on the opposite side of the bearing surface relative to the jaws, and the two centers of curvature are close to each other in all of the closing phase positions of the first and second branches.

14. The pliers as claimed in claim 13, wherein the bearing surface is circular.

15. The pliers as claimed in claim 8, wherein the bearing surface is arched, with a virtual center of curvature situated outside the overall perimeter of the first and second branches and on the opposite side of the bearing surface relative to the jaws, and the two centers of curvature are coincident.

16. The pliers as claimed in claim 15, wherein the bearing surface is circular.

17. The pliers as claimed in claim 1, wherein said bearing element cooperates with said bearing surface by sliding and/or rolling.

18. The pliers as claimed in claim 1, wherein the bearing surface cooperates by bearing against the bearing element.

19. An adjustable pair of pliers operable one-handedly, said pliers comprising:

first and second branches which cross, each of said branches defining a jaw and a handle, and an intermediate articulation region between the jaw and the handle, the first branch having, in its intermediate region, a guide surface of elongate shape along which a guide means secured to the intermediate region of the second branch can move, and, an articulation surface along which an articulation means can be positioned, the pliers further comprising means for locking the articulation means along the articulation surface, wherein the pliers comprise a rear bearing region which is defined, on the one hand, by a bearing element of one of the first and second branches and, on the other hand, by a bearing surface of elongate shape of the other of the first and second branches arranged to cooperate with the bearing element by a mutual bearing movable along the bearing surface, the bearing element and the bearing surface being situated between the intermediate region and the handle of the respective branches, the arrangement being such that during the closure phase of the pliers, in each position of the first and second branches, the bearing surface and the bearing element both remain in a roughly fixed position with respect to the respective branches, and a relative movement of the guide means along the guide surface and a relative movement of the bearing element along the bearing surface occur simultaneously, and wherein the bearing element is urged by a spring towards the bearing surface and toward a predetermined stop position.

20. The pliers as claimed in claim 19, comprising an opening spring which tends to move the two jaws constantly apart.

21. The pliers as claimed in claim 19, wherein, in all the closing phase positions of the first and second branches, the normal to the points of contact of the guide surface and of the bearing surface form a V, the point of which points towards the side of the first and second branches that faces away from the jaws.

22. The pliers as claimed in claim 21, wherein the angle of the V is roughly equal to 90°.

23. The pliers as claimed in claim 19, wherein the bearing element can retract against the action of the spring when the handles are brought together while the jaws are engaged on an object that is to be clamped and the locking means are activated.

24. The pliers as claimed in claim 23, wherein the locking means are activated by the jaws coming into engagement with said object and by said closing force being continued.

25. The pliers as claimed in claim 23, wherein the locking means are deactivated by the release of said closing force.

26. The pliers as claimed in claim 23, wherein the articulation means is a finger articulated freely to the second branch.

27. The pliers as claimed in claim 23, wherein the articulation means is a finger urged elastically toward the disengagement of its locking means with respect to the articulation surface.

28. The pliers as claimed in claim 23, wherein the spring is incorporated into the branch which bears the bearing element.

29. An adjustable pair of pliers operable one-handedly, said pliers comprising:

first and second branches which cross, each of said branches defining a jaw and a handle, and an intermediate articulation region between the jaw and the handle, the first branch having, in its intermediate region, a guide surface of elongate shape along which a guide means secured to the intermediate region of the second branch can move, and, an articulation surface along which an articulation means can be positioned, the pliers further comprising means for locking the articulation means along the articulation surface, wherein the pliers comprise a rear bearing region which is defined, on the one hand, by a bearing element of one of the first and second branches and, on the other hand, by a bearing surface of elongate shape of the other of the first and second branches arranged to cooperate with the bearing element by a mutual bearing movable along the bearing surface, the bearing element and the bearing surface being situated between the intermediate region and the handle of the respective branches, the arrangement being such that during the closure phase of the pliers, in each position of the first and second branches, the bearing surface and the bearing element both remain in a roughly fixed position with respect to the respective branches, and a relative movement of the guide means along the guide surface and a relative movement of the bearing element along the bearing surface occur simultaneously, wherein, in all the closing phase positions of the first and second branches, the normal to the points of contact of the guide surface and of the bearing surface form a V, the point of which points towards the side of the first and second branches that faces away from the jaws.

30. The pliers as claimed in claim 29, comprising an opening spring which tends to move the two jaws constantly apart.

31. The pliers as claimed in claim 29, wherein the bearing element is urged by a spring towards the bearing surface and toward a predetermined stop position.

32. The pliers as claimed in claim 29, wherein the angle of the V is roughly equal to 90°.

* * * * *